US006502924B1

(12) United States Patent
Muramatsu et al.

(10) Patent No.: US 6,502,924 B1
(45) Date of Patent: Jan. 7, 2003

(54) RECORDING HEAD AND IMAGE RECORDING APPARATUS UTILIZING SAID RECORDING HEAD

(75) Inventors: Hiroyuki Muramatsu; Seiji Kuwabara; Tatsuru Sato; Kouji Kawaguchi; Shunichi Tanaka; Tokuya Akase, all of Chiba (JP)

(73) Assignee: Seiko Instruments R&D Center Inc. (JP)

( * ) Notice: Subject to any disclaimer, the term of this patent is extended or adjusted under 35 U.S.C. 154(b) by 0 days.

(21) Appl. No.: 09/695,171

(22) Filed: Oct. 24, 2000

(30) Foreign Application Priority Data

Oct. 29, 1999 (JP) ..... 11-309124
Oct. 19, 2000 (JP) ..... 2000-319793

(51) Int. Cl.[7] ..... B41J 2/04

(52) U.S. Cl. ..... 347/54

(58) Field of Search ..... 347/54, 68, 69, 347/70, 71, 72, 50, 40, 20, 44, 47, 27, 63; 399/261; 361/700; 29/890.1; 310/328–330

(56) References Cited

U.S. PATENT DOCUMENTS 6,224,193 B1 * 5/2001 Minemoto et al. ..... 347/55

* cited by examiner

*Primary Examiner*—Raquel Yvette Gordon
(74) *Attorney, Agent, or Firm*—Adams & Wilks

(57) ABSTRACT

In an electrostatic acceleration type ink jet recording apparatus, when a voltage is preliminarily applied to ink to adjust the width of ink raises, a dedicated drive circuit has been necessary or dedicated electrodes have been necessary for forming the ink raises. According to a recording apparatus of the present invention, machining such as chamfering or steps is provided to a support body having a slit-like opening portion or, alternatively, a surface treatment such as coating an oil repellent solvent to a portion to be machined. Due to such a constitution, the width of the ink raises in the lateral direction of the opening portions can be made constant without using a method such as an electric driving so that a stable printing of dots is ensured. Further, by increasing the ink raise width in the vicinity of a central portion of the opening portion than at end portions of the opening portion, it becomes possible to prevent the diameter of dots to be printed from becoming non-uniform in the longitudinal direction of the opening portion.

22 Claims, 8 Drawing Sheets

FIG. 11
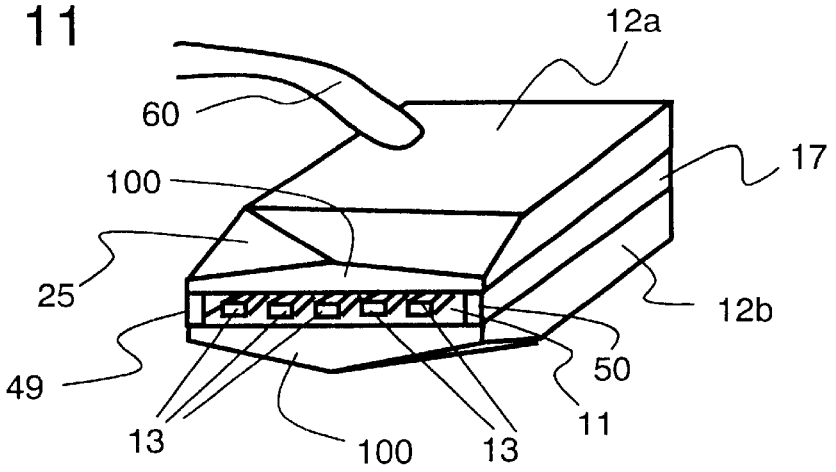
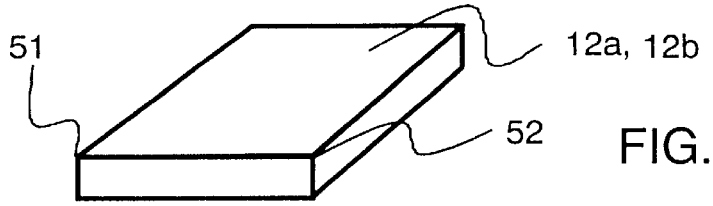
FIG. 12A
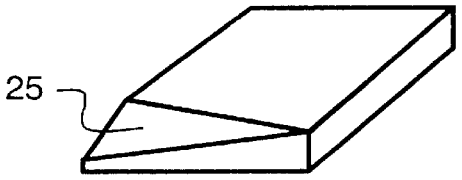
FIG. 12B
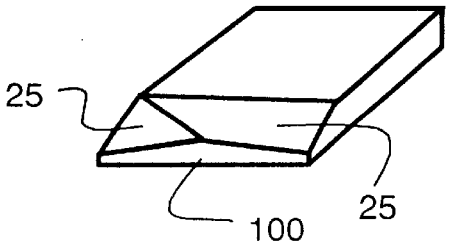
FIG. 12C

RECORDING HEAD AND IMAGE RECORDING APPARATUS UTILIZING SAID RECORDING HEAD

BACKGROUND OF THE INVENTION

1. Field of the Invention

The present invention relates to an ink jet recording head and an image recording apparatus which can obtain output images satisfying needs of industries in a wide range of field including a printing industry where a high-speed outputting of high-quality images is required, a printer industry which must meet office and personal demands and a consumer article industry which requires low-cost general-use output equipment capable of using versatile recording sheets.

2. Description of the Related Art

A constitution of a conventional electrostatic acceleration type ink jet recording head is explained hereinafter in conjunction with FIG. 15. The recording head is constituted such that ink 111 is filled in a slit defined by slit members 112, 113. A plurality of electrodes 114 which apply a voltage to ink are disposed in the inside of the slit member 112. Ink 111 is fed to a distal end of the head by way of an ink supply passage not shown in the drawing.

By applying a voltage to every other electrode 114 from a power supply not shown in the drawing and grounding other electrodes, electric fields are generated around electrodes to which the voltage is applied. At this point of time, with respect to ink 111 filled in the inside the slit, raises 1R of a liquid surface are formed at the electrode portions to which the voltage is applied. Although an applied signal necessary for ejecting ink must be not less than 3 msec, when the voltage of −200 V is applied to the electrodes 114 of the slit member 113, the raises of approximately 50 $\mu$m are formed at the voltage-applied electrode portions. By arranging a counter electrode not shown in the drawing at a position where the counter electrode faces the above-mentioned raises of the ink liquid surface in an opposed manner and then applying a signal voltage of 500 V and 300 $\mu$sec having rectangular waves to these electrodes, ink droplets are ejected from the raised portions of the ink liquid surface corresponding to the magnitude of applied signal and circular pixels having a diameter of approximately $\phi$150 $\mu$m are formed on a recording sheet (see Japanese Patent. No. 1987697).

The recording head and the recording method used in the conventional electrostatic acceleration type ink jet recording system have following drawbacks.

That is, by preliminarily forming raises of ink by applying a voltage to ink, following problems arise.

(1) A separate drive circuit becomes necessary besides driving for ejecting ink.

(2) To ensure forming of raises of ink having a stable shape, it becomes necessary to generate the stable electric field and hence, there may be a case that additional electrodes are necessary besides electrodes for ejecting ink.

(3) Since it is necessary to preliminarily apply a voltage to ink, ink may be charged at positions other than desired pixel positions and hence, there may be a case that dot printing cannot be obtained at desired positions.

(4) Since shape of the raises of ink such as the width thereof in a lateral direction of an opening portion or the radius of curvature thereof are adjusted electrically, the shape is liable to be influenced by moisture, temperature and physical properties of ink and hence, it is difficult to form the shape of ink raises in a stable manner. Further, since the diameter of dots to be printed is largely influenced by the magnitude of the shape of the raises of ink, it has been difficult to control the diameter of dots to be printed to a fixed size.

(5) With respect to the ink jet recording head having a slit-like opening portion, at the time of performing a continuous printing, the supply of ink cannot follow the printing in the vicinity of the center of the opening portion and hence, the shortage of ink supply occurs there. Further, in the longitudinal direction of the slit opening portion, since a charge generated by the electric field concentration is liable to be stored in ink at head end portions, a larger amount of ink is liable to be ejected from the end portions. Accordingly, in the longitudinal direction of the opening portion, the diameter of dots to be printed becomes larger at the end portions than at the center position.

SUMMARY OF THE INVENTION

In an ink jet recording head and an image recording apparatus according to the present invention, the profiling such as chamfering or forming of steps is performed on a support body that defines a slit-like opening. To be more specific, an ink raise portion formed in a periphery of the opening portion on the support body is processed such that a width in the lateral direction (hereinafter called "ink raise width") of a bottom surface portion with which ink comes into contact (hereinafter called "ink holding bottom surface") is set to a desired width thus forming ink raise width setting means.

Alternatively, surfaces other than the ink holding bottom surface in the vicinity of the opening portion are made of an oleophobic or hydrophobic component and further the ink holding bottom surface is made of an oleophilic or hydrophilic component. Due to such constitutions, the ink raise width in the lateral direction of the opening portion can be easily controlled to a fixed value without using a method such as an electric drive so that the diameter of dots to be printed can be controlled in a stable manner.

Further, by setting the value of the ink raise width to a value of a given rate relative to the size of dots to be printed, a desired size of dots can be set and the printing can be performed in a stable manner.

Still further, by providing the above-mentioned ink raise width setting means to respective positions of recording electrodes disposed at the above-mentioned opening portion, the number of defective dots can be reduced.

In addition, by increasing the value of the ink raise width in the support body in the vicinity of a central portion of the opening portion than end portions of the opening portion in the longitudinal direction of the opening portion, the diameter of dots to be printed is prevented from becoming irregular in the longitudinal direction of the opening portion.

BRIEF DESCRIPTION OF THE DRAWINGS

FIG. 11 is a schematic view of an ink jet recording head of an embodiment 6 of the present invention;

FIGS. 12A–12C are schematic views for explaining a method for manufacturing the ink jet recording head of the embodiment 6;

DETAILED DESCRIPTION OF THE PREFERRED EMBODIMENTS

In an ink jet recording head and an image recording apparatus according to the present invention, a profiling such as chamfering or forming steps is performed on a support body which defines a slit-like opening portion. Due to such a constitution, the ink raise width in the lateral direction of the opening portion can be easily controlled to a fixed value without using a method such as an electric drive so that the diameter of dots to be printed can be controlled in a stable manner.

Alternatively, surfaces other than the ink holding bottom surface in the vicinity of the opening portion are made of an oleophobic or hydrophobic component or the ink holding bottom surface is made of an oleophilic or hydrophilic component. Due to such a constitution, provided that the ink supply pressure is held at a fixed value, the ink raise width at the head opening portion in the lateral direction of the opening can be fixed and hence, it becomes possible to control the diameter of dots to be printed in a stable manner.

Further, by providing the ink raise width setting means to respective positions of recording electrodes, the number of defective dots can be reduced.

In addition, by setting the ink raise width setting means such that the ink raise becomes smaller as the ink raise is positioned away from the center to the ends of the opening portion in the longitudinal direction of the opening portion, the diameter of dots to be printed is prevented from becoming irregular in the longitudinal direction of the opening portion.

Embodiments of the ink jet recording head and the image recording apparatus according to the present invention are explained in conjunction with attached drawings hereinafter.

(Embodiment 1)

Figure 1:
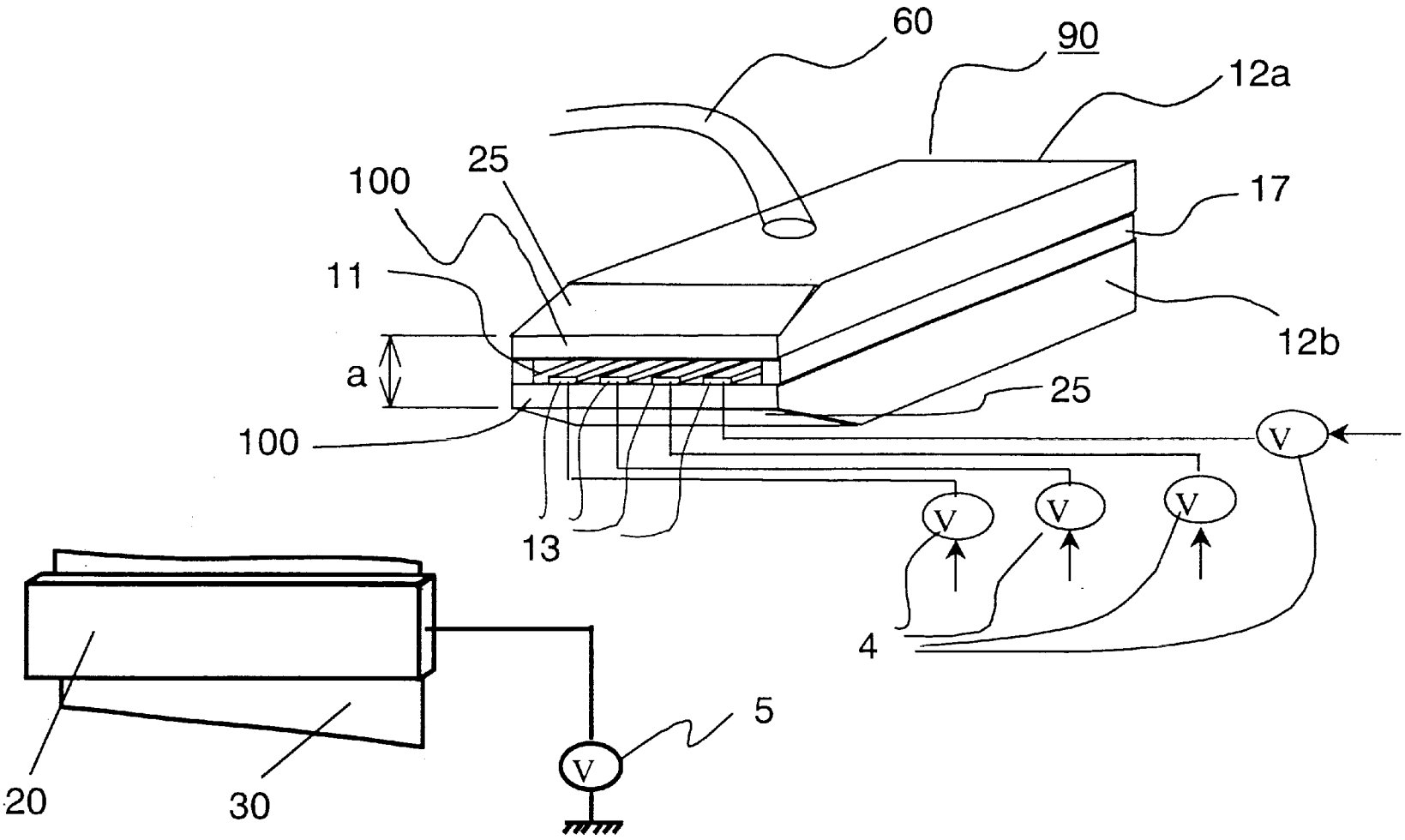
FIG. 1 is a schematic view showing a schematic constitution of an image recording apparatus of the present invention.
Figure 2:
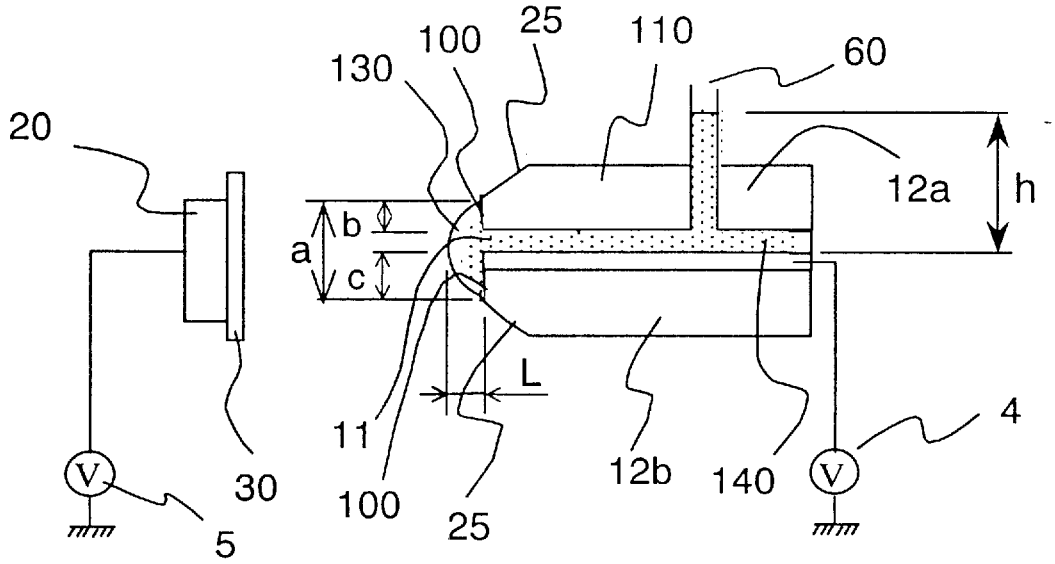
FIG. 2 is an explanatory view of an image recording apparatus of the present invention.

FIG. 1 is a perspective view showing the ink jet recording head of the image recording apparatus according to an embodiment of the present invention and the arrangement of a counter electrode and a recording sheet. FIG. 2 is a lateral view showing the image recording apparatus of FIG. 1 and the arrangement of a counter electrode and a recording sheet.

First of all, constitutional components of the image recording apparatus according to this embodiment are explained.

In FIG. 1, assuming the longitudinal direction of an opening portion 11 as a main scanning direction and the lateral direction of the opening portion 11 as a sub scanning direction, a plurality of recording electrodes 13 are arranged on a head lower plate 12*b* at a fixed interval in the main scanning direction. Further, insulating members 17 are mounted on the head lower plate 12*b* and an upper plate 12*a* is mounted on the insulating members 17 so as to form the opening portion 11. The opening portion 11 is communicated with an ink chamber not shown in the drawing. A plurality of recording electrodes 13 are electrically connected to power supplies 4. Voltages corresponding to image signals can be respectively and selectively applied to a plurality of recording electrodes 13 by means of control means not shown in the drawing.

A counter electrode 20 is arranged in a spaced apart manner from the opening portion with a fixed gap and a recording sheet 30 is disposed between the counter electrode 20 and the opening portion 11 by means of a paper conveying system not shown in the drawing. The gap is preferably set to 0.3 mm to 1 mm. The counter electrode 20 is connected to a power supply 5 and a voltage having a potential different from the potential of the recording electrodes 13 can be applied to the counter electrode 20. The recording sheet 30 may be a plain paper or a non-paper material such as OHP or the like.

To form the shape of opening portion with high accuracy, the head upper plate 12*a* and the head lower plate 12*b* may preferably be made of glass or Si. In this embodiment, glass (volume resistivity $1.0\times10^{15}\Omega\cdot$cm) was used.

Patterning of the recording electrodes 13 was performed by depositing aluminum on a substrate in vacuum and thereafter performing a chemical etching processing on this aluminum thin film. The number of the recording electrodes is not specifically limited and depends on the capacity of an IC driver for switching. Further, the recording electrodes 13 are preferably arranged at a pitch of 50 to 150 $\mu$m. In this embodiment, the recording electrodes 13 are formed at a pitch of 140 $\mu$m.

Although the recording electrodes 13 are formed of aluminum as material thereof in this embodiment, the material is not specifically limited to aluminum. Metal material such as copper, chromium, gold, nickel or the like may be used.

Further, so long as the counter electrode 20 has a surface thereof which faces the opening portion 11 in an opposed manner arranged parallel to the opening portion 11, the shape of other portions of the counter electrode 20 is not limited. Although the counter electrode 20 is made of stainless steel which is hardly eroded and injured in this embodiment, the counter electrode 20 may be made of metal material such as aluminum, copper or the like.

Then, the conditions of ink which can be used in the present invention are explained.

Among physical properties of ink, as factors which largely contribute to the ejection of ink, the surface tension, the volumetric resistance, the viscosity and the like are named. The relationship between the surface tension and the maximum distance of ink ejected to the counter electrode (hereinafter called "maximum recording distance") is, assuming that the volume resistivity and the viscosity are fixed, increased corresponding to the decrease of the surface tension when the surface tension falls in arrange of 20–50 dyn/cm. Accordingly, the smaller the surface tension, the resistance force in the ink ejection procedure is decreased and hence, even when the electric field is weak, the ink ejection becomes possible whereby the maximum recording distance can be increased. In general, the aqueous ink has the high surface tension and it is 72.8 dyn/cm (20° C.) when pure water is used. However, since it is 20 dyn/cm to 35 dyn/cm when an organic solvent is used and hence, ink which is produced by dissolving dye in the organic solvent can be used as ink suitable for the present invention. Further, by dissolving an anion surfactant, a cation surfactant, a nonionic surfactant as a surfactant into such ink, the surface tension is enhanced so as to increase the maximum recording distance.

The viscosity of the ink solvent can be selected in a wide range. However, since the solvent having the low viscosity has the high volatility, the storage stability of ink is deteriorated. To ensure the storage stability, the solvent which falls in a range where the boiling point is not less than 200° C. is selected. Assuming that the surface tension and the volume resistivity are fixed, the relationship between the viscosity and the maximum recording distance is increased corresponding to the decrease of the viscosity. Accordingly, in the same manner as the surface tension, when the viscosity is low, the resistance force in the ink ejection procedure is decreased whereby the maximum recording distance can be increased.

Injecting ink, since it is necessary to apply an electric charge from the recording electrodes 13 of the head portion to ink, it is desirable that the volume resistivity is high. In this embodiment, ink having the volume resistivity of $1.0\times10^{7}$–$1.0\times10^{9}$ (Ω·cm) was used.

With respect to the above-mentioned ink characteristics set values, the possibility of ink ejection depends on the value of a voltage supplied between a common electrode and the recording electrodes on the counter electrode, the distance to the counter electrode, the width of an ejection opening or the like. Accordingly, it is needless to say that the characteristics range of the optimum surface tension, viscosity, volume resistivity and the like is not specifically limited to the above-mentioned values.

Voltages applied to the counter electrode 20 and the recording electrodes 13 are controlled by means of a switching circuit not shown in the drawing in response to image signals. Because of the potential difference between the counter electrode 20 and the recording electrodes 13, the Coulomb force is generated in ink and ink is ejected from the opening portion 11 to the counter electrode 20 in the vicinity of the selected recording electrodes due to this Coulomb force.

In this manner, the dot-like recording is performed. Upon completion of printing corresponding to one line of the recording head, the recording sheet 30 is moved in the sub scanning direction by a given feed amount by means of a sheet feeding mechanism not shown in the drawing. By repeating the above-mentioned operations, a recorded picture is formed. Further, by preparing a plurality of ink jet recording heads shown in FIG. 1 and instructing respective heads to eject ink of different colors and performing a printing by overlapping a plurality of dots which differ in colors, a color image can be drawn on the recording sheet 30.

Subsequently, the manner of setting the ink raise width according to this embodiment is explained in conjunction with FIG. 2. FIG. 2 is a side view of the ink jet recording head and the image recording apparatus of this embodiment. To control the width of an ink raise 130 in the lateral direction of the opening portion to a fixed width, chamfered portions 25 are formed in the vicinity of the opening portion. With chamfered portions 25, an ink holding portion 100 is formed on a distal end of the head. The chamfered portions 25 are formed by polishing distal ends of corner portions of the head upper plate 12*a* and the head lower plate 12*b*.

The head upper plate 12*a*, the head lower plate 12*b* are made of glass having a thickness of 0.5 mm. Remaining thickness b, c after chamfering was set to 0.12 mm and the thickness of insulating members 17 was set to approximately 0.06 mm so as to set the ink holding height a to approximately 0.3 mm.

Ink is supplied to the ink holding portion 100 by means of ink supply means 60 shown in FIG. 2 through an ink chamber while receiving an ink dead weight and an approximately fixed pressure due to atmospheric pressure. The static pressure applied to the ink balances with the surface tension of ink at the ink holding portion 100 and forms a semicircular convex surface, that is, a meniscus and holds this state. Accordingly, the ink raise width is determined by the ink holding height "a" which is formed by the ink holding portion 100 and an ink flow passage 140.

Further, with the provision of the chamfered portions 25, when the surface tension is collapsed and ink overflows from the ink holding portion 100, ink can easily flow toward an upper surface of the head upper plate 12*a* and a lower surface of the head lower plate 12*b* so that the dwelling of ink around the ink holding portion 100 can be prevented.

Subsequently, the static pressure applied to ink and the shape of the ink raise 130 formed in such a state are explained.

By assuming the height of the liquid surface of ink as h, the surface tension of ink as σ, the density of ink as ρ, a contact angle at the time of receiving the back pressure F as θ, a bulging amount of ink as L, and a radius of curvature as r, a contact angle θ which balances with the back pressure is expressed by a following equation (1).

$$\theta = \mathrm{Arc}\cos\left(\frac{a\rho gh}{2\sigma}\right) \tag{1}$$

The radius of curvature r of the ink raise 130 in cross section is expressed by a following equation (2).

$$r = \frac{a}{2\cos\left(\frac{\pi}{2} - \theta\right)} \tag{2}$$

The bulging amount L of the ink raise 130 is expressed by a following equation (3).

$$L = r - \sqrt{r^2 - \frac{a^2}{4}} \tag{3}$$

Further, assuming that the limit which the ink raise 130 is collapsed and flows out toward the chamfered portions 25 is set such that θ=90°, the ink height h at the time of such collapsing can be expressed by a following equation (4).

$$h = \frac{2\sigma}{\rho g a} \tag{4}$$

As mentioned above, the limit values of the radius of curvature and the bulging amount of the ink raise 130 are determined by the ink holding height a when the surface tension of ink is fixed.

Further, when the voltage value applied to ink and the voltage applying time are fixed, taking the concentration of the electric field into account, the diameter of dots to be printed is largely influenced by the radius of curvature r and the bulging amount L of the ink raise 130 so that it is understood that the diameter of the dots to be printed is determined by the ink holding height a.

Figure 3:
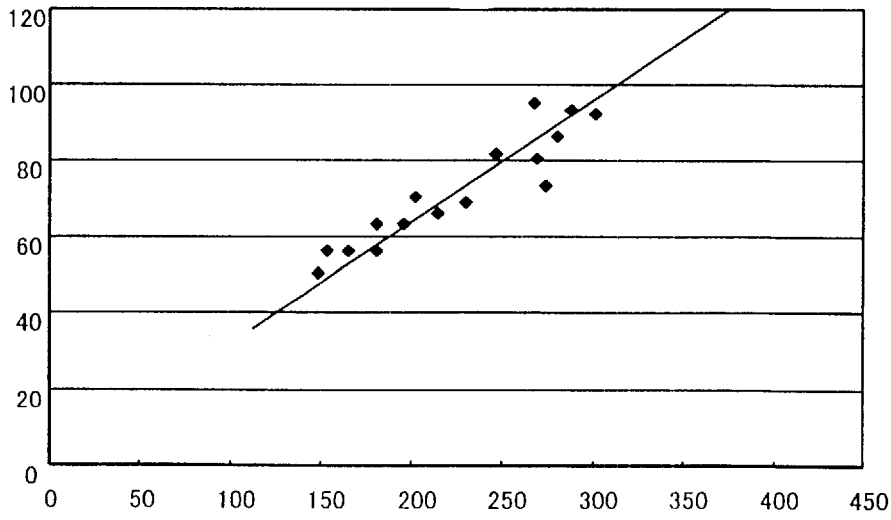
FIG. 3 is a graph showing a correlation between the ink raise width and the size of dots.

According to this embodiment, when the voltage applied to the recording electrodes 13 was set to −300 V, the voltage applied to the counter electrode 20 was set to +2700 V, the distance between the head and the counter electrode 20 was set to 1.0 mm, the ink liquid surface height h was set to 1.0 cm, and the bulging amount L of the ink meniscus was set to 10–20 μm, as shown in FIG. 3, an apparent correlation was obtained between the ink raise width, that is, the ink holding height a and the size of the printing dots was obtained. As shown in FIG. 3, it can be understood that the relationship between the ink raise width and the diameter of printing dots is the linear relationship.

For example, when the ink raise width was set to 300 μm, the diameter of dots which were printed became approximately 100 μm. Although the evaluation of the ink holding height a was actually performed with respect to the ink raise width down to approximately 150 μm, it is considered that the similar tendency may be obtained even when the ink raise width is set to equal to or less than 150 μm, according to the relations among the equations (1)–(4).

Accordingly, by setting the ink holding height a to a given value, the size of the diameter of the dots can be controlled.

Different from this embodiment, when the applied voltage is changed, when the distance between the head and the counter electrode 20 is changed, when a given static voltage is applied to ink, or when the constitution of the head is changed, there may be a case that the above-mentioned relationship is not established. In such a case, it is necessary to measure a relationship such as the relationship shown in FIG. 3 each time.

(Embodiment 2)

Figure 4:
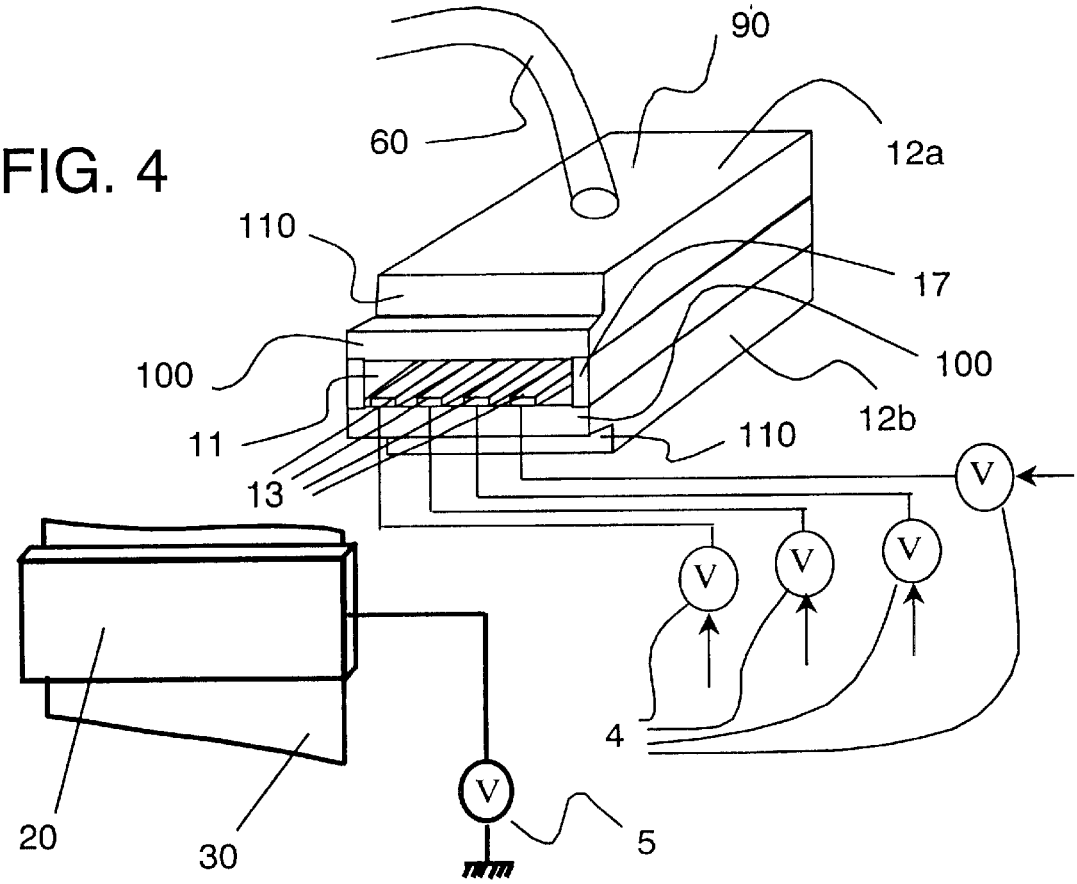
FIG. 4 is a schematic view showing an outline constitution of an image recording apparatus according to an embodiment 2 of the present invention.
Figure 5:
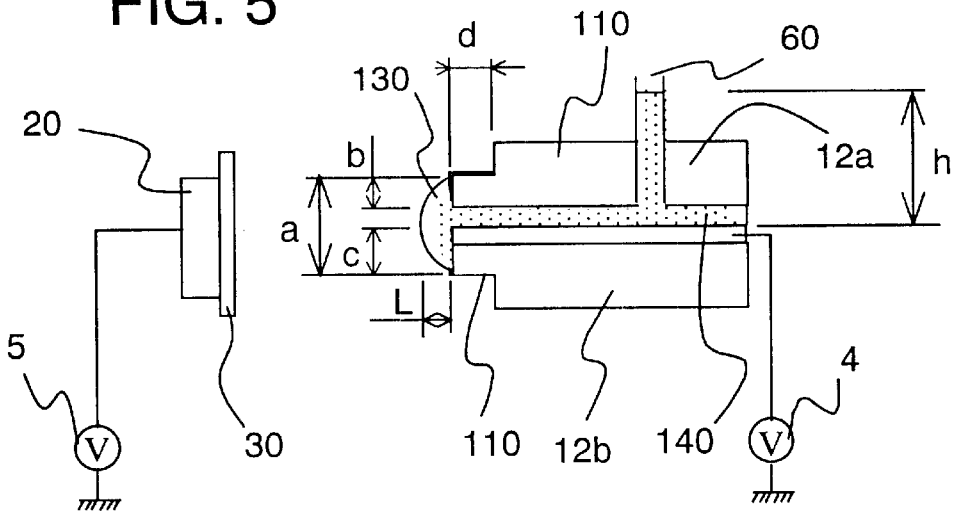
FIG. 5 is an explanatory view of an image recording apparatus of the embodiment 2 of the present invention.

An image recording apparatus according to an embodiment 2 of the present invention is shown in FIG. 4 and FIG. 5.

FIG. 4 is an explanatory view showing the image recording apparatus of this embodiment. In FIG. 4, an ink holding portion 100 is formed by providing steps 110 to a head upper portion 12*a* and a head lower portion 12*b*. Other constitutions of this embodiment are equal to those of the embodiment 1. Subsequently, the manner of adjusting the ink raise width is explained in conjunction with FIG. 5.

FIG. 5 is a side view of the ink jet recording head of this embodiment. The steps 110 are formed on the head in the vicinity of the opening portion so as to control the width of an ink raise 130 in the lateral direction of the opening portion to a fixed value. With the provision of the steps 110, an ink holding portion 100 is formed on a distal end of the head. The steps 110 may be formed by polishing the distal ends of the head upper plate 12*a* and the head lower plate 12*b* using dicing or by etching them or the like.

The ink raise (ink meniscus) 130 can be sufficiently formed with steps 110 having a depth d of approximately 0.5 mm–1.0 mm. In this embodiment, the depth d was set to 0.5 mm by dicing the distal ends of the head upper plate 12*a* and the head lower plate 12*b*.

The head upper plate 12*a*, the head lower plate 12*b* are made of glass having a thickness of 0.5 mm. Remaining thickness b, c after dicing was set to 0.12 mm and the thickness of insulating members 17 was set to approximately 0.06 mm so as to set the ink holding height a to approximately 0.3 mm.

Ink is supplied to the ink holding portion 100 by means of ink supply means 60 shown in FIG. 5 through an ink chamber while receiving an ink dead weight and an approximately fixed pressure due to atmospheric pressure. The static pressure applied to ink balances with the surface tension of ink at the ink holding portion 100 and forms a semicircular convex surface, that is, a meniscus and holds this state. Accordingly, the ink raise width is determined by the ink holding height a which is formed by the ink holding portion 100 and an ink flow passage 140.

Although the steps 110 are formed by dicing in this embodiment, the steps 110 may be formed by etching, sand blasting or the like. Further, although the relationship between the ink holding height a and the diameter of the printing dots is slightly fluctuated due to the supply pressure for forming the ink meniscus and the surface tension of ink, a fixed relationship is obtained when these parameters are identical. That is, a tendency similar to that shown in FIG. 3 may be obtained.

(Embodiment 3)

Figure 6:
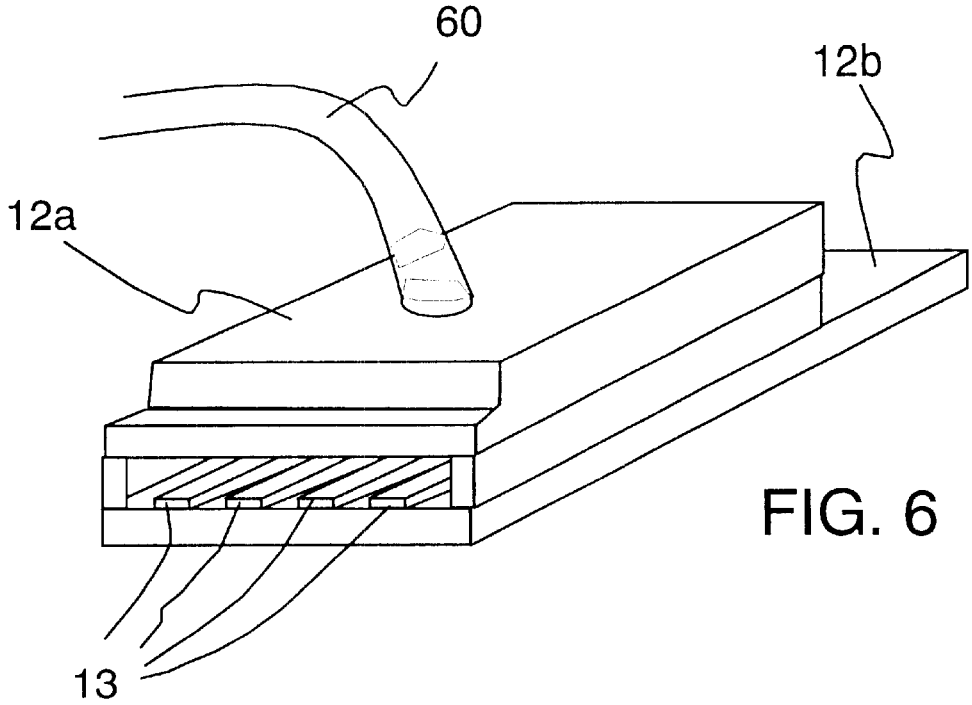
FIG. 6 is a schematic view of an ink jet recording head of an embodiment 3 of the present invention.

An ink jet recording head according to another embodiment of the present invention is explained in conjunction with FIG. 6. FIG. 6 is a perspective view of this embodiment. In FIG. 6, a counter electrode and a recording sheet are not shown in the drawing.

As shown in FIG. 6, by providing a step only to a head upper plate 12*a* by dicing or the like, the forming operation of an ink holding portion is facilitated. Other constitutions are identical with the constitutions of the embodiment 1. In this embodiment, it is possible to manufacture the ink jet recording head by performing a processing only to the head upper plate 12*a* after joining the head upper plate 12*a*, a head lower plate 12*b* and an ink supply passage 60 so that with respect to the ink holding height a and the size of dots to be printed, the similar tendency as that of the embodiment 1 can be obtained.

(Embodiment 4)

Figure 7:
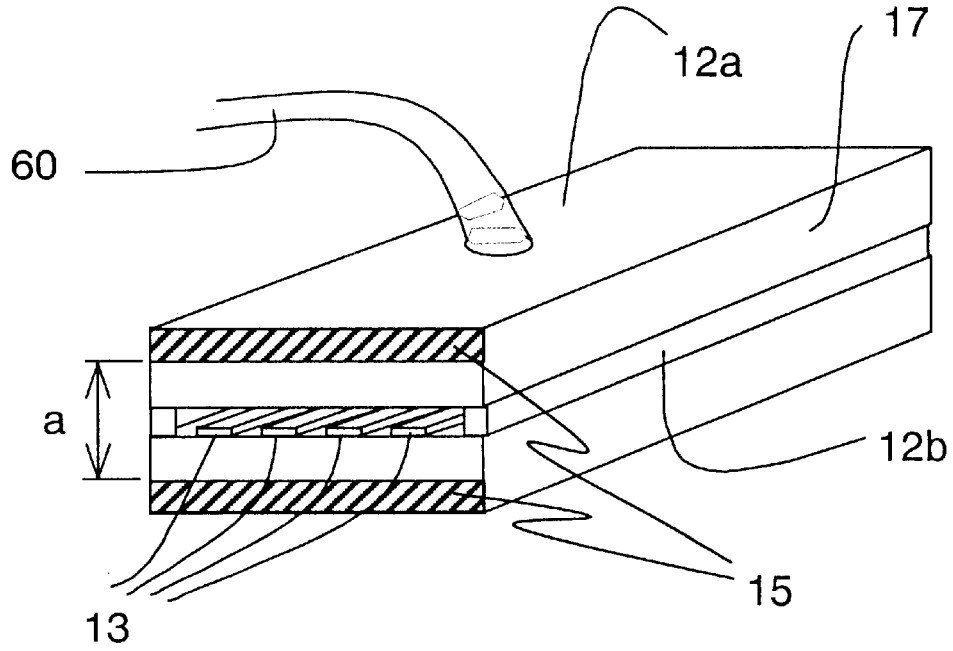
FIG. 7 is a schematic view of an ink jet recording head of an embodiment 4 of the present invention.
Figure 8:
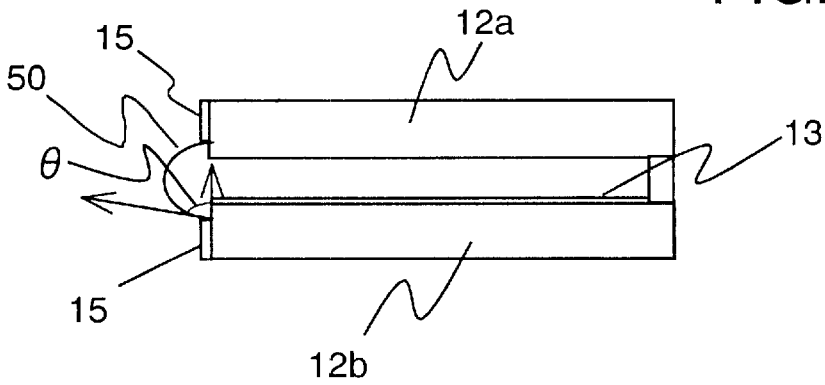
FIG. 8 is an explanatory view of an ink jet recording head of an embodiment 4 of the present invention.

An ink jet recording head according to another embodiment of the present invention is explained in conjunction with FIG. 7 and FIG. 8. FIG. 7 is a perspective view of this embodiment and FIG. 8 is a side view of a head upper plate 12*a*, a head lower plate 12*b* and recording electrodes 13. In FIG. 7 and FIG. 8, a counter electrode and a recording sheet are not shown. Further, an ink supply passage is omitted in FIG. 7.

In the structure shown in FIG. 7, a surface treatment is applied to end surfaces of the head upper plate 12*a* and the head lower plate 12*b* which are made of insulating substrate material and constitute an opening portion such that an oil repellent agent 15 having an oleophobic property, that is, a property to repel ink used in this embodiment is coated on portions of these end surfaces other than a desired ink raise width, whereby ink does not flow into the region of the oil repellent agent 15. Other constitutions are identical with those of the embodiment 1.

In FIG. 8, ink supplied to an ink chamber defined between the head upper plate 12*a* and the head lower plate 12*b* through unshown ink supply passage is fed to the opening portion formed on a distal end of the head and forms an ink raise 130 in the state that a desired ink raise width is ensured at end portions of the oil repellent agent 15.

In this embodiment, as the oil repellent agent 15, fluorine system resin was coated on the end surfaces of the head upper plate 12*a* and the head lower plate 12*b*. A contact angle between ink and the head upper plate 12*a* and the head lower plate 12*b* is determined by material, surface conditions or the like of the head upper plate 12*a* and the head lower plate 12*b*. When ink described in the embodiment 1 was used and glass was used as the material of the head upper plate; 12*a* and the head lower plate 12*b*, and the profile of the head upper plate 12*a* and the head lower plate 12*b* was cut by dicing as a machining method, the contact angle θ of ink shown in FIG. 8 was approximately 10°–20°.

When the oil repellent agent 15 was coated in the manner as described in this embodiment, the contact angle of ink shown in FIG. 8 became 70° and ink could obtain a desired ink raise width.

Since the region where the oil repellent agent 15 is not coated becomes the ink holding height a, the ink raise width is determined by the region where the oil repellent agent 15 is not coated.

In the same manner as the embodiment 1, the tendency shown in FIG. 3 could be obtained. Since the ink holding height a can be obtained without using machining, the ink holding height a can be formed with a relatively high accuracy.

In this embodiment, by applying the surface treatment to the distal end of the opening portion, the oleophobic property is ensured in the designated area so as to regulate the ink raise width. However, so long as the surface component of the distal end of the opening portion has conditions equivalent to the above-mentioned conditions, the regulation of the ink raise width is not limited to the above manner. For example, the material per se of the designated area of the opening portion may be formed of material having the oleophobic property.

Further, contrary to this embodiment, it is needless to say that by constituting the ink raise width portion of the opening portion with an oleophilic component which has wettability for ink used in this embodiment, it is possible to regulate the ink raise width. In this case, by making the portions other than portion corresponding to the ink raise width oleophobic, the above-mentioned advantageous effect can be further enhanced.

Further, by providing the similar treatment to the head having the structure explained in the embodiment 1 or the embodiment 2, the advantageous effect can be still further enhanced.

(Embodiment 5)

Figure 9:
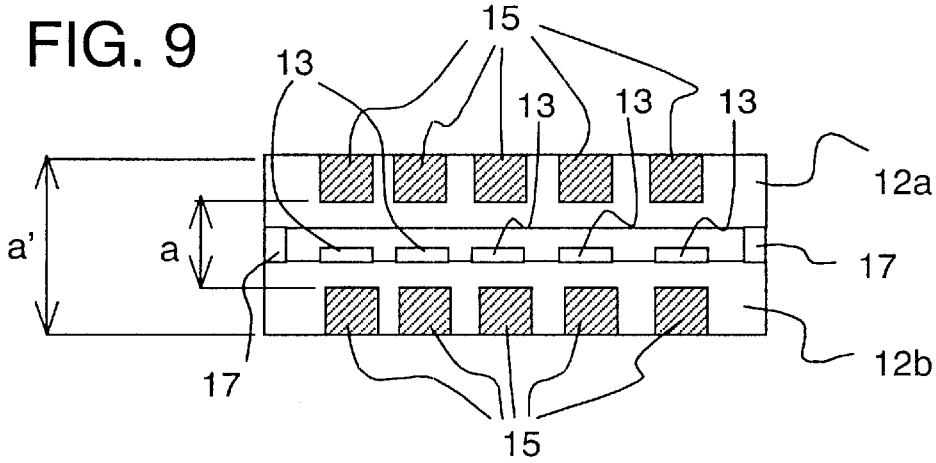
FIG. 9 is an explanatory view of an ink jet recording head of an embodiment 5 of the present invention.
Figure 10:
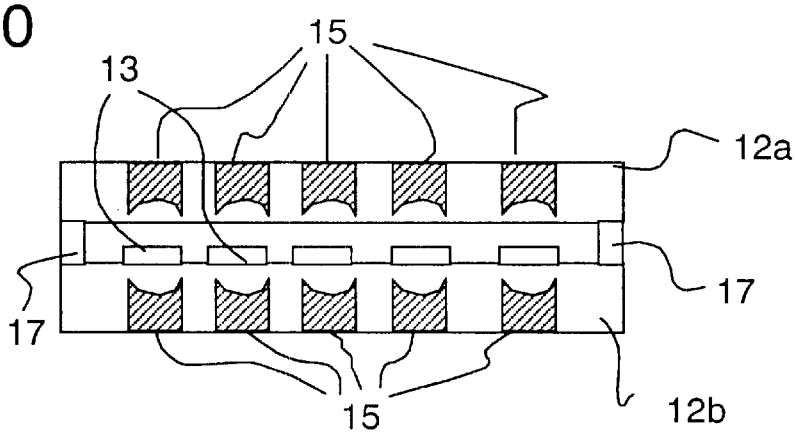
FIG. 10 is an explanatory view of an ink jet recording head of the embodiment 5 of the present invention.

An ink jet recording head according to another embodiment of the present invention is explained in conjunction with FIG. 9 and FIG. 10. FIG. 9 and FIG. 10 are front views of this embodiment. In FIG. 9 and FIG. 10, a counter electrode, an ink supply passage and a recording sheet are not shown.

In this embodiment, the ink holding height a is controlled by coating an oil repellent solvent 15 as in the case of the embodiment 3. However, in this embodiment, the ink holding height a' in the regions where the recording electrodes 13 are not present is made lower than the ink holding height a in the vicinity of the recording electrodes 13. Other constitutions are as same as those of the embodiment 1. In this manner, by increasing an amount of ink at the ink liquid surface in the vicinity of the recording electrodes 13, the selectivity of the ink ejecting positions can be enhanced.

In this embodiment, although the coating shape of the oil repellent agent 15 is rectangular, to make the shape of the printing dots closer to a circle, the coating may be formed into a half moon shape shown in FIG. 10.

Since it is difficult to form such a complicate shape by coating the oil repellent agent, it may be possible to pattern the oil repellent agent on a film having a thickness of several tens μm by printing and then adhering such a film on a head upper plate 12*a* and a head lower plate 12*b* so as to apply the oil repellent agent 15 to the end surface of the head.

Further, by coating an oleophilic solvent to regions other than regions where the oil repellent agent is coated so as to facilitate the landing of ink within the ink holding height, the further stable control of the ink raise width can be achieved.

(Embodiment 6)

An ink jet recording head according to another embodiment of the present invention is explained in conjunction with FIG. 11 and FIG. 12. FIG. 11 is a perspective view of this embodiment. A counter electrode and a recording sheet are not shown in FIG. 11. FIG. 12 is an explanatory view explaining a method for manufacturing a head upper plate 12*a* and a head lower plate 12*b* of an ink jet recording head of this embodiment.

In printing, when voltages are applied to the counter electrode not shown in the drawing and a plurality of recording electrodes 13, the electric field concentrates in the vicinity of the end portions 49, 50 of an opening portion 11 and hence, the ink charge is liable to dwell in the vicinity of both end portions 49, 50 of the opening portion 11 whereby there is a tendency that the shape of dots to be printed in the vicinity of both end portions 49, 50 of the opening portion 11 becomes large. Accordingly, the diameter of dots to be printed is different between a portion in the vicinity of a central portion and portions in the vicinity of both ends 49, 50 of the opening portion 11 so that the irregularities of concentration are generated between the central portion and both end portions resulting in the deterioration of the image quality.

However, as in the case of this embodiment, by forming the distal end shape of the head upper plate 12*a* and the head lower plate 12*b* such that the height of an ink holding portion 100 is gradually decreased in the direction toward the end portions 49, 50 of the opening portion 11, the ink raise width is also decreased in the direction toward the end portions 49, 50 of the opening portion 11. Due to such a constitution, the shape of the dots to be printed can be made uniform in the longitudinal direction of the opening portion 11.

FIG. 12 shows a method for manufacturing the head upper plate 12*a* and the head lower plate 12*b* of the ink jet recording head of this embodiment.

On the head upper plate 12*a* and the head lower plate 12*b* shown in FIG. 12A, a chamfering is performed from a corner 51 side at a given angle with the longitudinal direction of the ink holding portion 100 (FIG. 12B).

Subsequently, in the same manner, a chamfering is performed from a corner 52 side at a given angle with the longitudinal direction of the ink holding portion 100 (FIG. 12C).

Accordingly, the head upper plate 12*a* and the head lower plate 12*b* which form the ink holding portion 100 having a height thereof lowered at both end portions than at the central portion in the longitudinal direction of the opening portion 11 can be formed.

Although the head upper plate 12*a* and the head lower plate 12*b* are manufactured by performing chamfering on the head upper plate 12*a* and the head lower plate 12*b* a plural times in this embodiment, they may be manufactured by an injection molding using material such as resin or casting the resin in a given mold.

(Embodiment 7)

Figure 13:
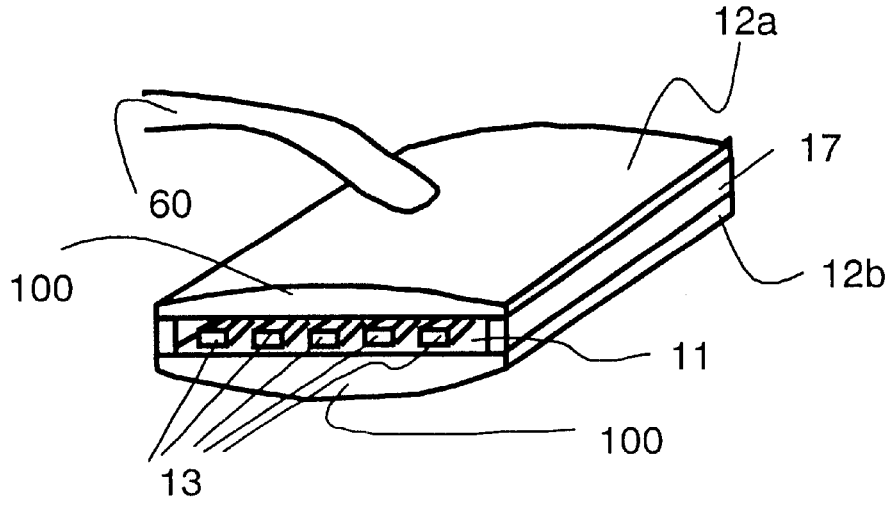
FIG. 13 is a schematic view of an ink jet recording head of an embodiment 7 of the present invention.

An ink jet recording head according to another embodiment of the present invention is explained in conjunction with FIG. 13. FIG. 13 is a perspective view of this embodiment. A counter electrode and a recording sheet are not shown in FIG. 13.

With the use of a head upper plate 12*a* and a head lower plate 12*b* having respective upper and lower surface portions formed into an arcuate shape, an advantageous effect similar to that of the embodiment 6 can be obtained.

(Embodiment 8)

Figure 14:
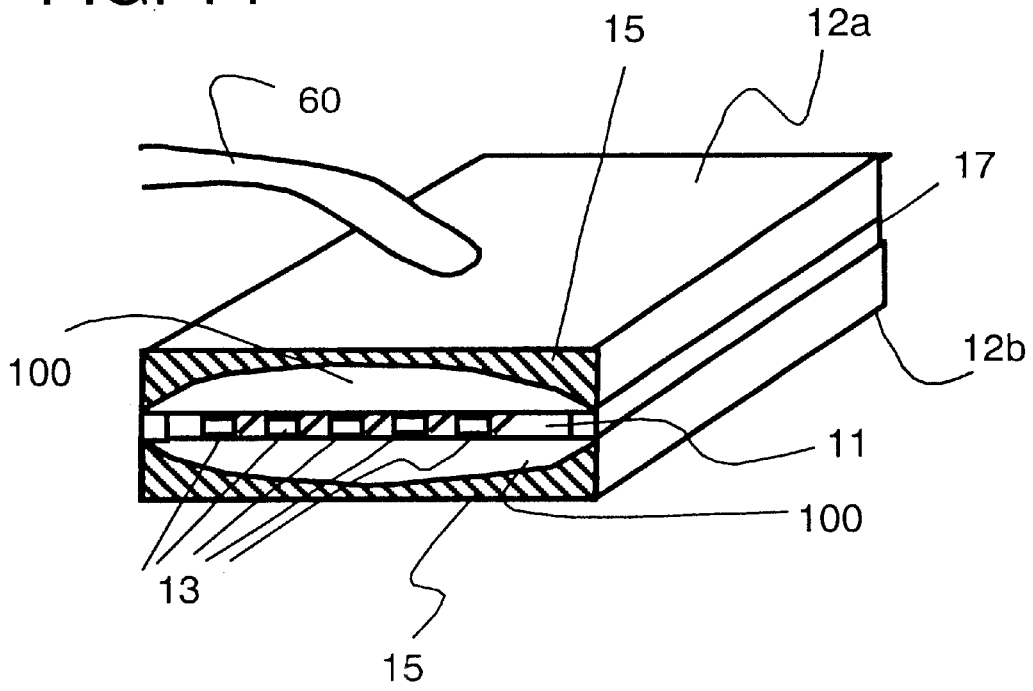
FIG. 14 is a schematic view of an ink jet recording head of an embodiment 8 of the present invention.
Figure 15:
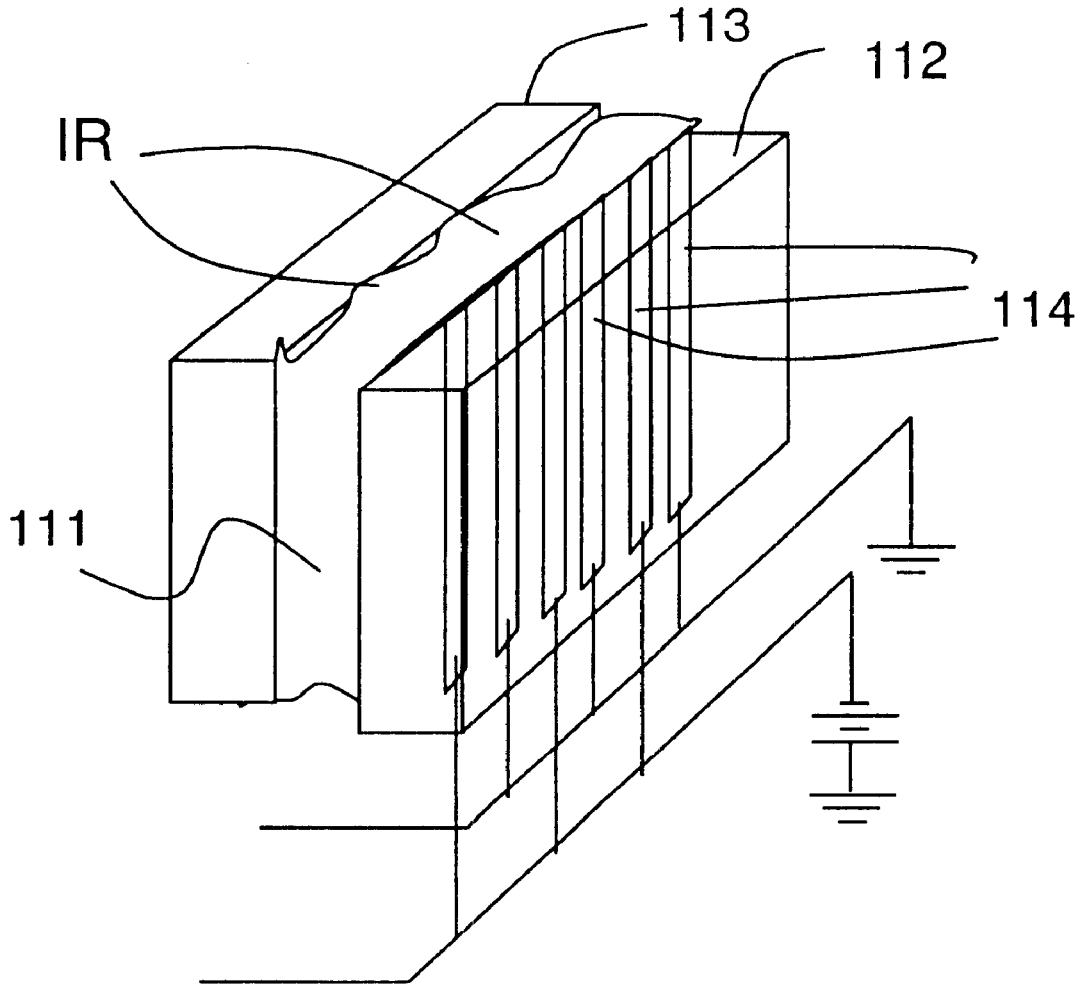
FIG. 15 PRIOR ART
FIG. 15 is an explanatory view showing a recording head of a conventional electrostatic acceleration type ink jet recording system.

An ink jet recording head according to another embodiment of the present invention is explained in conjunction with FIG. 14. FIG. 14 is a perspective view of this embodiment. A counter electrode and a recording sheet are not shown in FIG. 14.

As shown in FIG. 14, by coating an oil repellent agent 15 on ink holding portions 100 of a head upper plate 12*a* and a head lower plate 12*b* in such a manner that the area coated with the oil repellent agent 15 is increased at both end portions than the central portion in the longitudinal direction of an opening portion 11, an advantageous effect similar to that of the embodiment 6 can be obtained.

Further, a voltage applied to a plurality of recording electrodes 13 may be decreased in the direction from end portions to a central portion with respect to the longitudinal direction of the opening portion 11. In this case, it is necessary to connect a load which generates a given voltage drop between power supplies 4 and recording electrodes 13.

Further, by dividing a counter electrode not shown in the drawing in the longitudinal direction of the opening portion 11 in the same manner as the recording electrodes 13 and decreasing an applied voltage toward end portions with respect to the longitudinal direction of the opening portion 11, the similar advantageous effect can be obtained.

According to the ink jet recording head and the image recording apparatus using the ink jet recording head, by performing machining such as forming of steps on the plate-like members having the slit-like opening portions, the width of the ink raises in the lateral direction of the opening portion can be easily controlled to a fixed value without any electric drive method other than the ejection of ink so that the diameter of dots to be printed can be controlled in a stable manner.

Further, by setting the rate of the width of the ink raises in the lateral direction of the opening portion relative to the size of dots to be printed to a given value, the printing with desired size of dots can be performed in a stable manner.

Further, by performing the chamfering to a portion in the vicinity of the opening portion, unnecessary ink which overflows in the vicinity of the opening portion can be easily made to flow out from the region relevant with the ejection of ink. Accordingly, an advantageous effect that the generation of defective dots can be suppressed so that the stable printing of dots is ensured is obtained.

Still further, since the ink raise width is increased toward the central portion of the opening portion with respect to the longitudinal direction of the opening portion, an advantageous effect that the diameter of dots to be printed can be made uniform in the longitudinal direction of the opening portion can be obtained.

What is claimed is:

1. An ink jet recording head comprising:

a support body having an ink chamber communicating with an ink reservoir and an opening portion in a front surface communicating with the ink chamber so that the weight of the ink in the reservoir and atmospheric pressure balance with a surface tension of the ink at the opening portion to cause the ink to form a meniscus at the opening portion without application of a voltage to the ink, the meniscus having a concave portion and an ink raise portion comprising a convex portion adjacent to the concave portion and bulging outward of the opening portion of the support body to come in contact with the front surface of the support body proximate the opening portion;

a plurality of recording electrodes provided on the support body proximate the opening portion;

a counter electrode spaced apart from the opening portion by a given distance so that a recording medium may be passed between the support body and the counter electrode;

a power supply circuit for supplying voltages to the plurality of recording electrodes and the counter electrode; and ink raise width setting means for controlling a width of the ink raise portion by controlling a size of an area of the front surface of the support body proximate the opening portion in a lateral direction and at a bottom surface portion thereof at which ink comes into contact with the opening portion.

2. An ink jet recording head according to claim 1; wherein the ink raise width setting means comprises a predetermined shape of front surface of the support body proximate the opening portion for restricting the width of the ink raise.

3. An ink jet recording head according to claim 2; wherein the predetermined shape of the front surface of the support body proximate the opening portion forms an ink holding bottom surface for holding ink proximate the opening portion of the support body.

4. An ink jet recording head according to claim 2; wherein the predetermined shape of the front surface of the support body proximate the opening portion is a wedge-like shape which has a sharpened end portion thereof confronting the counter electrode and is formed by chamfering a portion of the front surface of the support body proximate the opening portion.

5. An ink jet recording head according to claim 2; wherein the predetermined shape of the front surface of the support body proximate the opening portion is a stepped shape formed by forming steps in the front surface of the support body proximate the opening portion.

6. An ink jet recording head according to claim 1; wherein the ink raise width setting means comprises a surface layer provided on the front surface of the support body to control the ink raise width proximate the opening portion.

7. An ink jet recording head according to claim 6; wherein the surface layer comprises a material having a hydrophobic or oleophobic property provided on the front surface proximate the opening portion in a region other than a region corresponding to a desired ink raise width.

8. An ink jet recording head according to claim 6; wherein the surface layer comprises a material having a hydrophilic or oleophilic property provided on the front surface proximate the opening portion in a region of a desired ink raise width.

9. An ink jet recording head according to any one of claims 1 to 8; wherein a meniscus is formed proximate each of the plurality of electrodes; and the ink raise width setting means comprises means for setting the width of ink raises formed at each of the respective recording electrodes.

10. An ink jet recording head according to claim 9; wherein the plurality of electrodes are spaced by a given interval in a longitudinal direction of the opening portion; and the ink raise width setting means sets the ink raise widths of the respective meniscuses to gradually decrease from a center of the opening portion to respective side ends of the opening portion in the longitudinal direction of the opening portion.

11. An ink jet recording head according to claim 9; wherein the plurality of electrodes are spaced by a given interval in a longitudinal direction of the opening portion; and an intensity of an electric field generated between the counter electrode and the recording electrodes is smaller at side ends of the opening portion than at a center of the opening portion in the longitudinal direction of the opening portion.

12. An ink jet recording head according to claim 1; wherein the ink raise width setting means sets a value of the ink raise width relative to a diameter of desired printing dots.

13. An image recording apparatus comprising: an ink jet recording head having an opening portion through which ink is ejected and a counter electrode spaced from and confronting the opening portion; and recording sheet conveying means for supplying a recording sheet in a gap between the opening portion and the counter electrode and scanning the recording sheet synchronously with driving of the recording head so that image pixels are adhered onto the recording sheet; wherein the ink jet recording head comprises the ink jet recording head according to claim 1.

14. A print head comprising: a support body defining an internal ink chamber and having a front surface provided with a slit in liquid communication with the ink chamber; and a plurality of electrodes provided in the support body proximate the slit and spaced apart by a fixed interval in a longitudinal direction of the slit to apply a voltage to ink contained in the support body to cause the ink to be ejected from the slit; wherein the support body is configured such that a weight of ink contained in the chamber causes the ink to form a meniscus at the slit proximate each of the electrodes without application of a voltage to the electrodes, the meniscus being defined such that the ink comes into contact with the front surface of the support body proximate the slit.

15. A print head according to claim 14; wherein the front surface of the support body is shaped to limit a width of the meniscus.

16. A print head according to claim 15; wherein the front surface of the support body is chamfered at top and bottom ends to limit the width of the meniscus.

17. A print head according to claim 16; wherein a wedge formed by the chamfered top and bottom ends of the front surface is larger in size at a central portion of the front surface than at side surfaces of the front surface and gradually decreases from the central portion to the side surfaces in the longitudinal direction of the slit.

18. A print head according to claim 15; wherein the front surface of the support body is stepped at top and bottom ends to limit the height of the meniscus.

19. A print head according to claim 14; wherein the front surface of the support body is has a layer provided thereon to limit a width of the meniscus.

20. A print head according to claim 19; wherein the layer comprises a material formed of a hydrophobic or oleophobic property provided on the front surface proximate the soit in a region other than a region corresponding to a desired width of the meniscus.

21. A print head according to claim 19; wherein the layer comprises a material formed of a hydrophilic or oleophilic property provided on the front surface proximate the slit in a region of a desired width of the meniscus.

22. A print head according to claim 14; further comprising a counter electrode spaced apart from the slit by a given distance so that a recording medium may be passed between the support body and the counter electrode; and a power supply circuit for supplying voltages to the plurality of electrodes and the counter electrode to perform a printing operation.

* * * * *